US005265394A

United States Patent [19]

Gardner

[11] Patent Number: 5,265,394

[45] Date of Patent: Nov. 30, 1993

[54] EXPANDABLE-RETRACTABLE PORTABLE STRUCTURE

[75] Inventor: Stewart E. Gardner, Napa, Calif.

[73] Assignee: X-SPAN-TEC Corporation, Napa, Calif.

[21] Appl. No.: 977,776

[22] Filed: Nov. 17, 1992

[51] Int. Cl.[5] ..... E04B 1/346

[52] U.S. Cl. ..... 52/640; 52/71

[58] Field of Search ..... 52/64, 71, 143

[56] References Cited

U.S. PATENT DOCUMENTS

| | | | |
|---|---|---|---|
| Re. 24,452 | 4/1958 | Meaker | 296/175 |
| 2,755,517 | 7/1956 | Sickel | 52/71 |
| 3,200,545 | 8/1965 | Buge | 52/66 |
| 3,292,971 | 12/1966 | Zucker | 52/64 X |
| 3,360,891 | 1/1968 | Gardner | 52/69 |
| 3,381,994 | 5/1968 | Link | 52/64 X |
| 3,469,356 | 9/1969 | White | 52/71 |
| 3,840,267 | 10/1974 | Honigman | 52/64 X |
| 4,155,204 | 5/1979 | Prozdske | 52/71 |
| 4,603,518 | 8/1986 | Fennes | 52/64 X |

*Primary Examiner*—Peter M. Cuomo
*Assistant Examiner*—Jerry Redman

[57] ABSTRACT

An expandable-retractable portable structure is provided which is capable of being transported on public highways in its retracted position. The structure has a stationary portion and a movable portion, wherein the movable portion pivotally encloses the stationary portion of the structure in the retracted configuration of the structure. The movable portion of the structure carries a winch which when activated causes the movable portion to move from the expanded configuration to a retracted configuration by pivotally enclosing the stationary portion of the structure. The winch is reversed in direction to rotate the movable portion from the retracted to its expanded configuration wherein maximum interior space is available within the structure for use.

5 Claims, 11 Drawing Sheets

EXPANDABLE-RETRACTABLE PORTABLE STRUCTURE

BRIEF SUMMARY OF THE INVENTION

This invention relates generally to expandable-retractable portable structures. More particularly, the invention relates to a portable structure having a retracted configuration in which the structure has allowable length, width and height to be transported on public highways. The structure has an expanded configuration in which maximum interior space is available for use.

The structure of the present invention may be used in conjunction with a trailer and chassis or in conjunction with a motor vehicle chassis which has its own mode of power. Alternately, the structure is capable of use without a wheeled chassis or frame. The structure is capable of being moved using a crane system similar to those used to maneuver cargo containers.

A primary object of the invention is to provide an expandable-retractable portable structure which may be transported over public highways in its retracted position and which can be readily converted to its expanded configuration wherein maximum interior space is available for use.

A further object of the invention is to provide an expandable-retractable portable structure wherein the retracted configuration is secure and highly resistant to vandalism, breaking and entering, animals and severe weather.

A further object of the invention is to provide an expandable-retractable portable structure which is readily converted from its retracted to its expanded configuration and vice versa; the conversion from one configuration to the other is accomplished by rotating the movable portion of the structure so that in the retracted position of the structure, the movable portion pivotally encloses the stationary portion of the structure.

Another object of the invention is to provide a winch carried by the movable portion of the structure, wherein the winch moves along with the movable portion of the structure; by so mounting the winch, a smooth and efficient motion is obtained in converting the structure from its retracted to its expanded configuration and vice versa.

Another object of the invention is to provide a wheeled frame for carrying the structure wherein the frame carries movable support beams which are movable from a first position in which the wheeled frame may be moved on a public highway to a second, extended position wherein the beams support the movable portion of the structure in its expanded configuration.

Other objects and advantages of the invention will become apparent from the following description of the preferred embodiments and the drawings wherein:

DETAILED DESCRIPTION OF THE DRAWINGS

Figure 1:
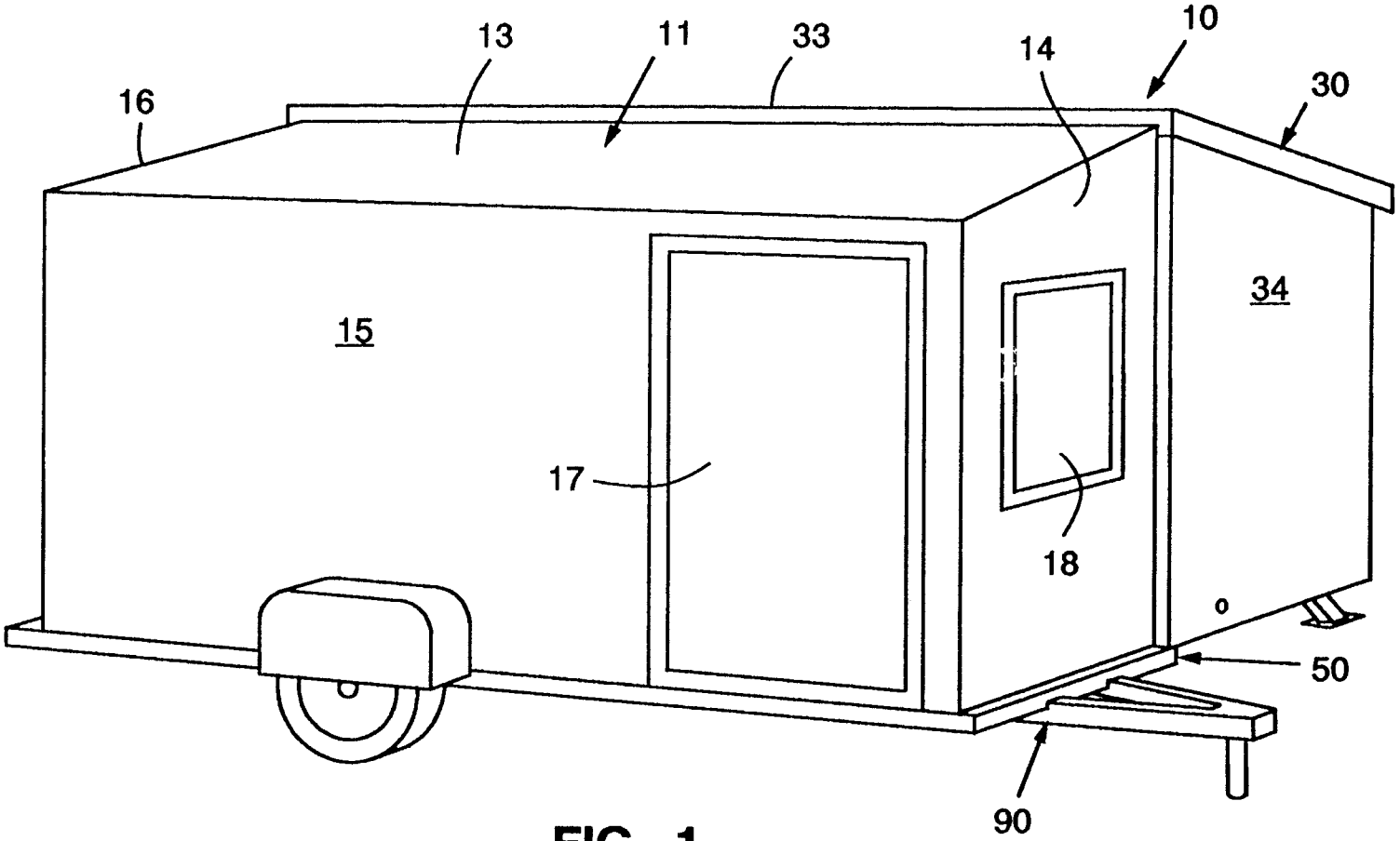
FIG. 1 is a perspective view of a structure according to the present invention shown in its expanded configuration.
Figure 2:
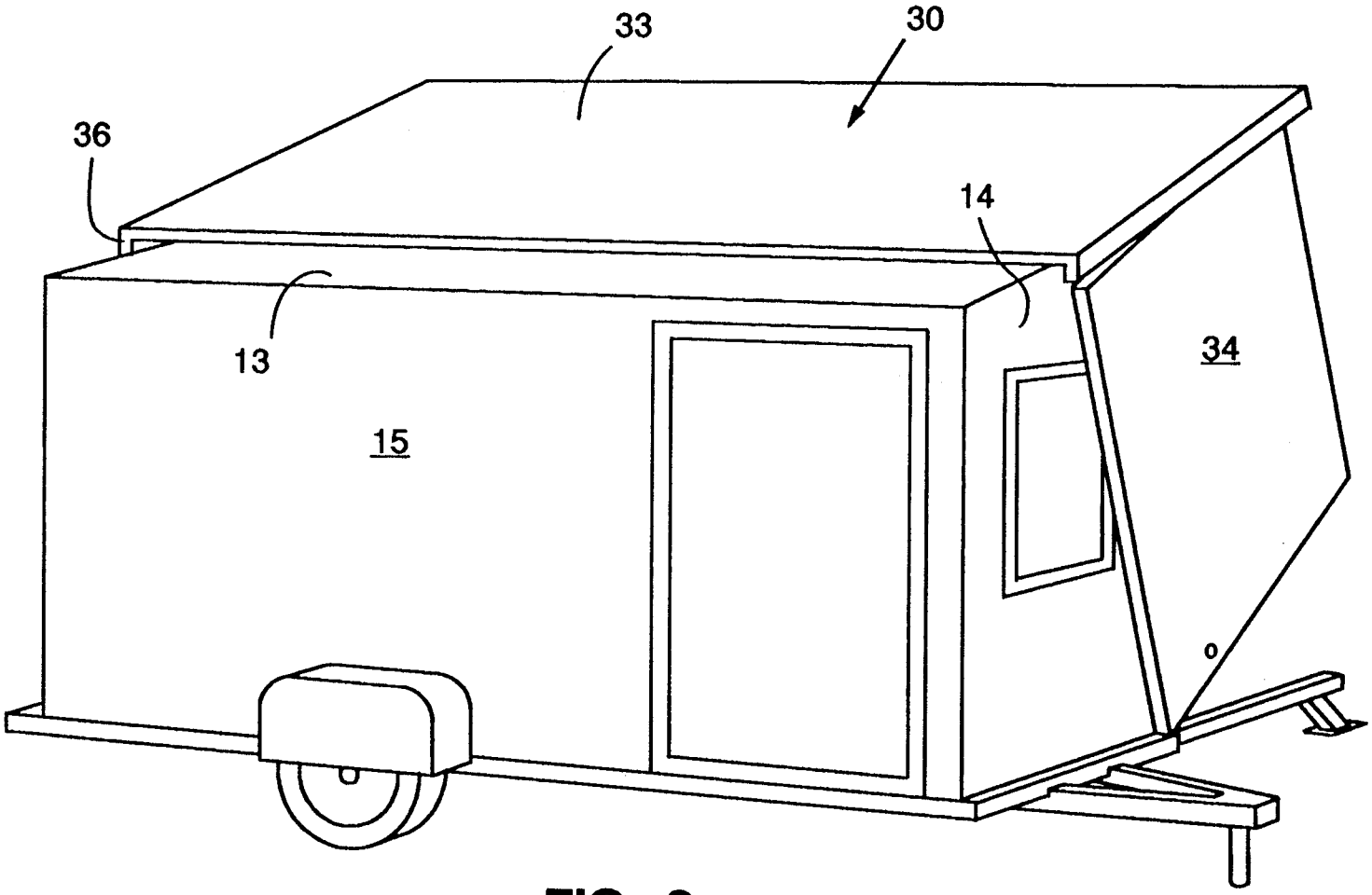
FIG. 2 is a perspective view of the structure shown in FIG. 1 wherein the movable portion of the structure is shown as it begins to move into the retracted configuration of the structure.
Figure 3:
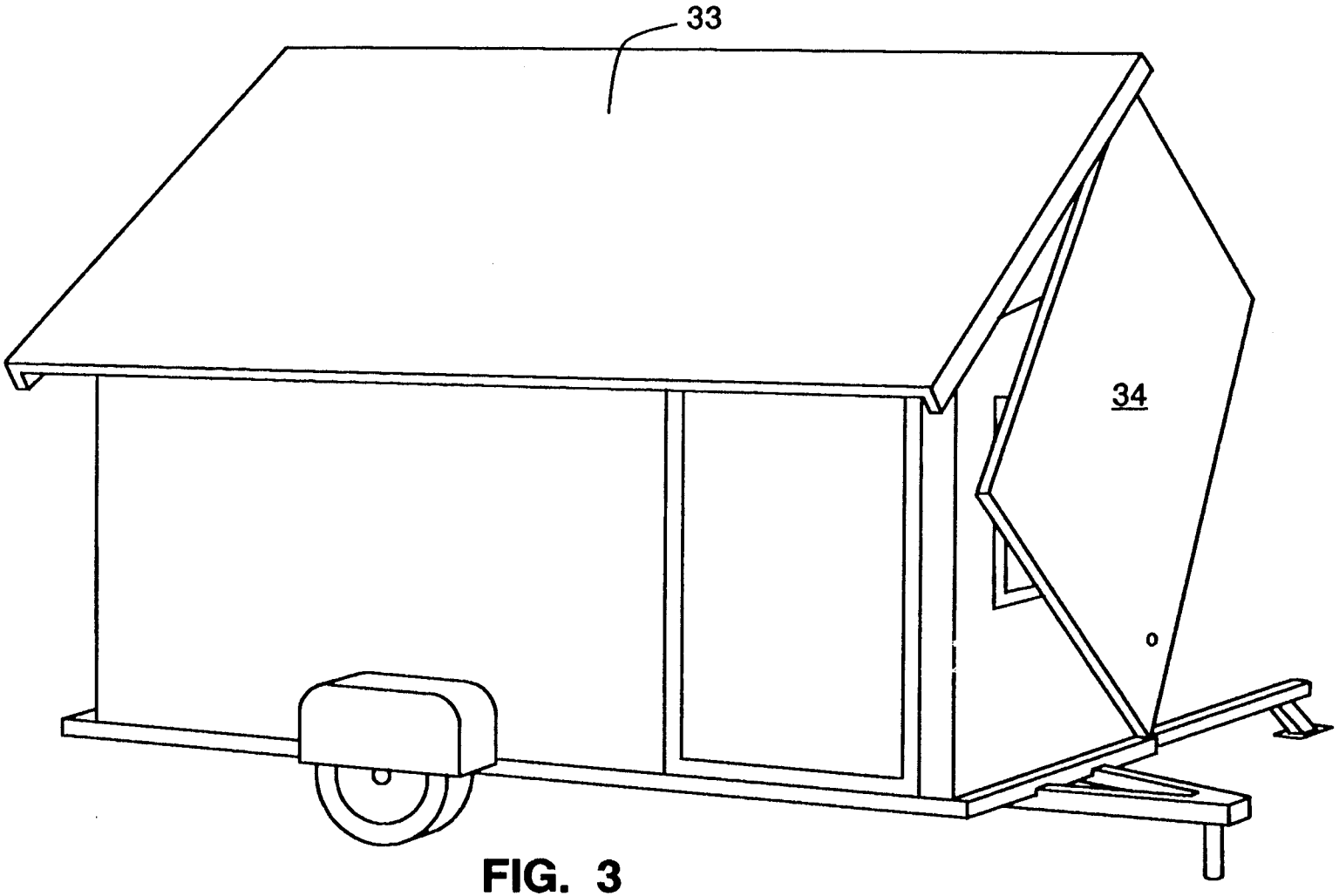
FIG. 3 is a perspective view of the structure shown in FIGS. 1 and 2 as the structure approaches its retracted configuration.

Referring to FIG. 1, an expandable-retractable portable structure is shown generally as 10. The structure has a stationary portion 11 and a movable portion 30.

The stationary portion 11 in the embodiment shown in FIG. 1 is permanently installed onto a wheeled frame 90. Wheeled frame 90 is a trailering chassis suitable for being transported over public highways. By referring to the portion 11 as a "stationary" portion, it is understood that it is stationary relative to the trailering chassis or wheeled frame 90, and that portion 11 is stationary with respect to movable portion 30 of the overall structure 10. Stationary portion 11 has a fixed floor 12 (FIG. 5), a fixed roof 13 and fixed side walls 14, 15 and 16. An access door 17 is provided in side wall 15 and window 18 is provided in front wall 14 of stationary portion 11.

Movable portion 30 has a floor 32 (FIG. 5), a roof 33 and walls 34, 35 and 36. Floor 32 has an inner edge 38 which is located adjacent the floor 12 of stationary portion 11. Floor 32 has an outer edge 39 parallel to inner edge 38 and which extends under side wall 35 of movable portion 30. A hinge means 50 is carried by the inner edge 38 of movable floor 32 (FIG. 5).

Figure 4:
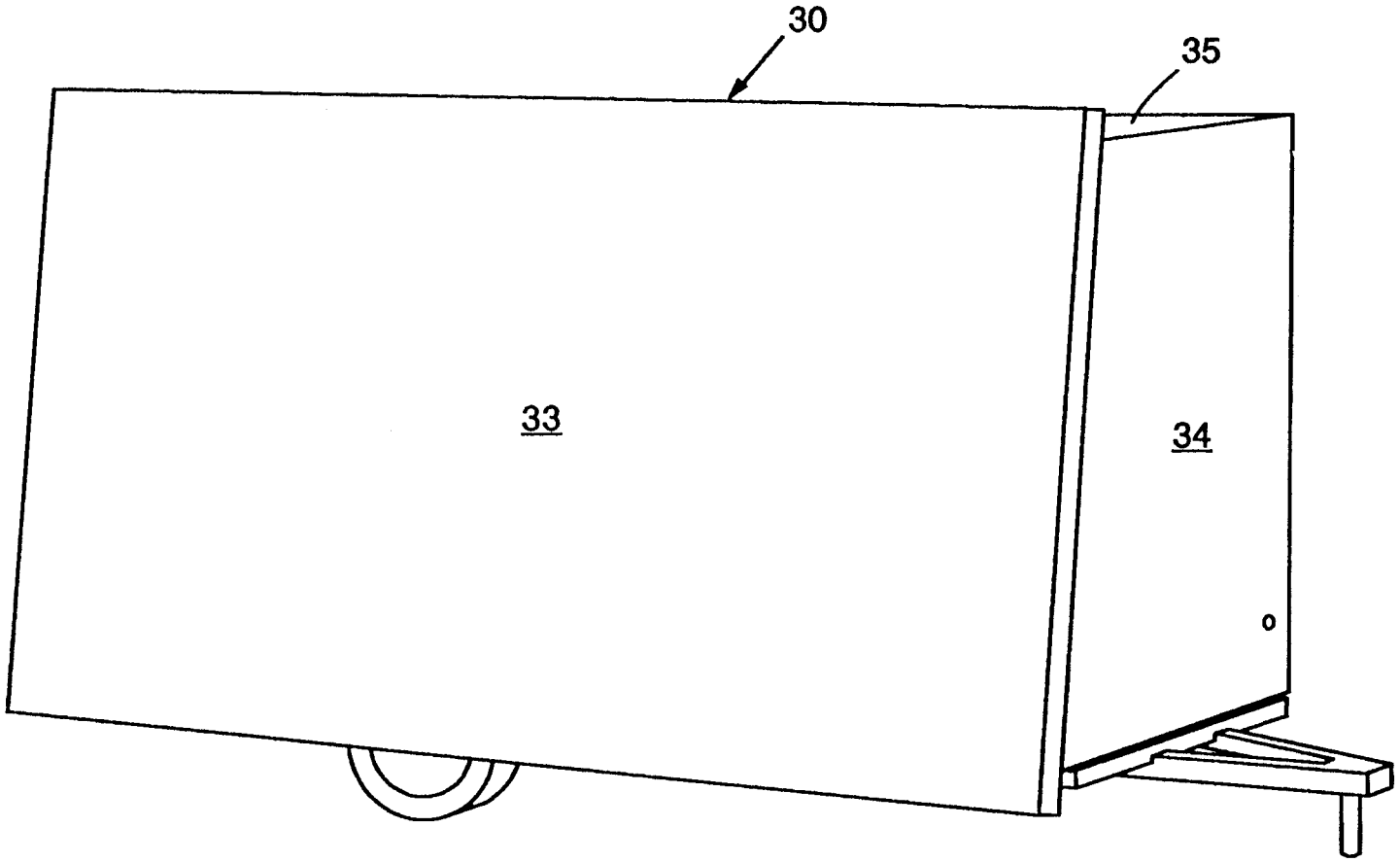
FIG. 4 is a perspective view of the structure shown in FIGS. 1–3 wherein the structure is in its fully retracted configuration.

As shown in FIGS. 1–4, as movable portion 30 is moved from its expanded configuration shown in FIG. 1 into its retracted configuration shown in FIG. 4, movable portion 30 rotates about an axis formed by hinge means 50 (FIG. 5) through approximately 90° and pivotally encloses stationary portion 11. As shown in FIG. 4, movable portion 30 has pivotally enclosed stationary portion 11. In the retracted position shown in FIG. 4, the structure is in a relatively secure condition in which it is highly resistant to vandalism, unauthorized entry, severe weather and wild animals. The structure may be left in this position for extended periods of time.

The retracted position shown in FIG. 4 is preferably of such dimension as to permit legal transportation on public highways. Since the retracted position of the structure is relatively secure, the structure of the present invention may be used for a wide variety of purposes including emergency housing, seasonal farm labor, exposition displays, military hospitals, workshops, test site laboratories, classrooms, recreational cottages, construction site offices, department of forestry, prisons and scout camp bunkhouses.

Figure 5:
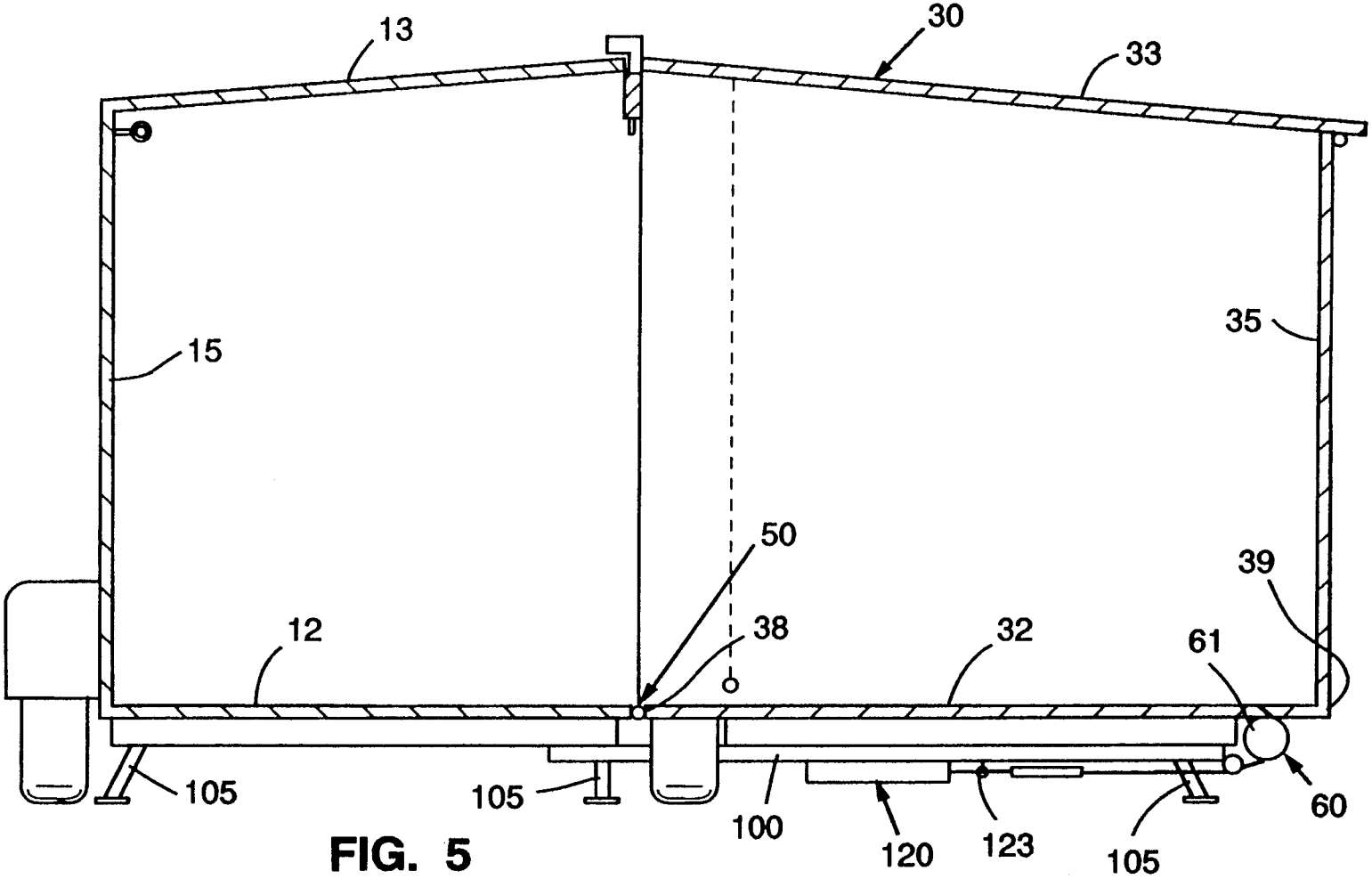
FIG. 5 is a sectional view of the structure shown in FIGS. 1–4.

As shown in FIG. 5, hinge means 50 is connected to inner edge 38 of movable floor 32. Hinge means 50 extends along the length of edge 38 of floor 32 and allows movable portion 30 to pivot about hinge means 50 as shown in FIGS. 1-4.

Figure 5A:
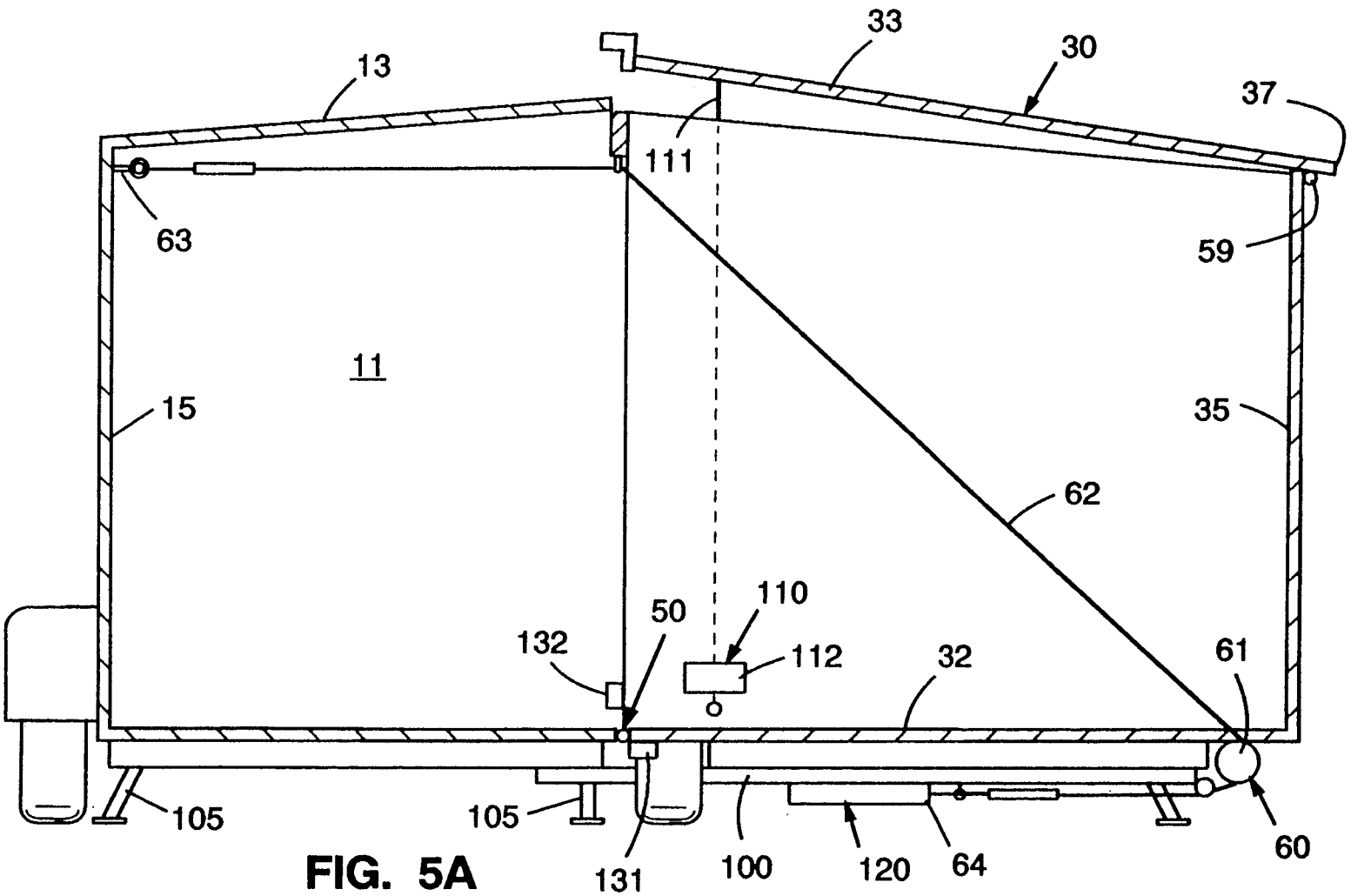
FIG. 5A is a sectional view of the structure which shows the structure in the initial stage of being retracted.

Winch means 60 is carried by the floor 32 of movable portion 30. Winch means 60 is carried beneath floor 32 near the outer edge 39 of floor 32 to provide for the maximum distance between winch means 60 and hinge means 50. Winch means 60 includes a reversible winch 61 and a continuous loop cable system 62 shown best in FIG. 5A. In operation, as the spooling drum of winch 61 rotates, that portion of the cable connected to one end of the drum is spooling in cable at the same rate that another cable connected to the other end of the drum is spooling out. As shown in FIGS. 5 and 5A, a 12 volt reversible winch 61 is utilized. Winch 61 could be powered by manual, hydraulic, magnetic or other means. In utilizing the 12 volt winch in the embodiment shown in FIGS. 1-5A, approximately one minute is required to go from the fully expanded configuration of FIG. 1 to the retracted position shown in FIG. 4. Approximately the same amount of time is required to go from the retracted position of FIG. 4 to the expanded position of FIG. 1.

As shown best in FIG. 5A, cable 62 is anchored at one end 63 to the upper portion of side wall 15 of stationary portion 11. The other end 64 of cable 62 is anchored to support beam 100.

Figure 6:
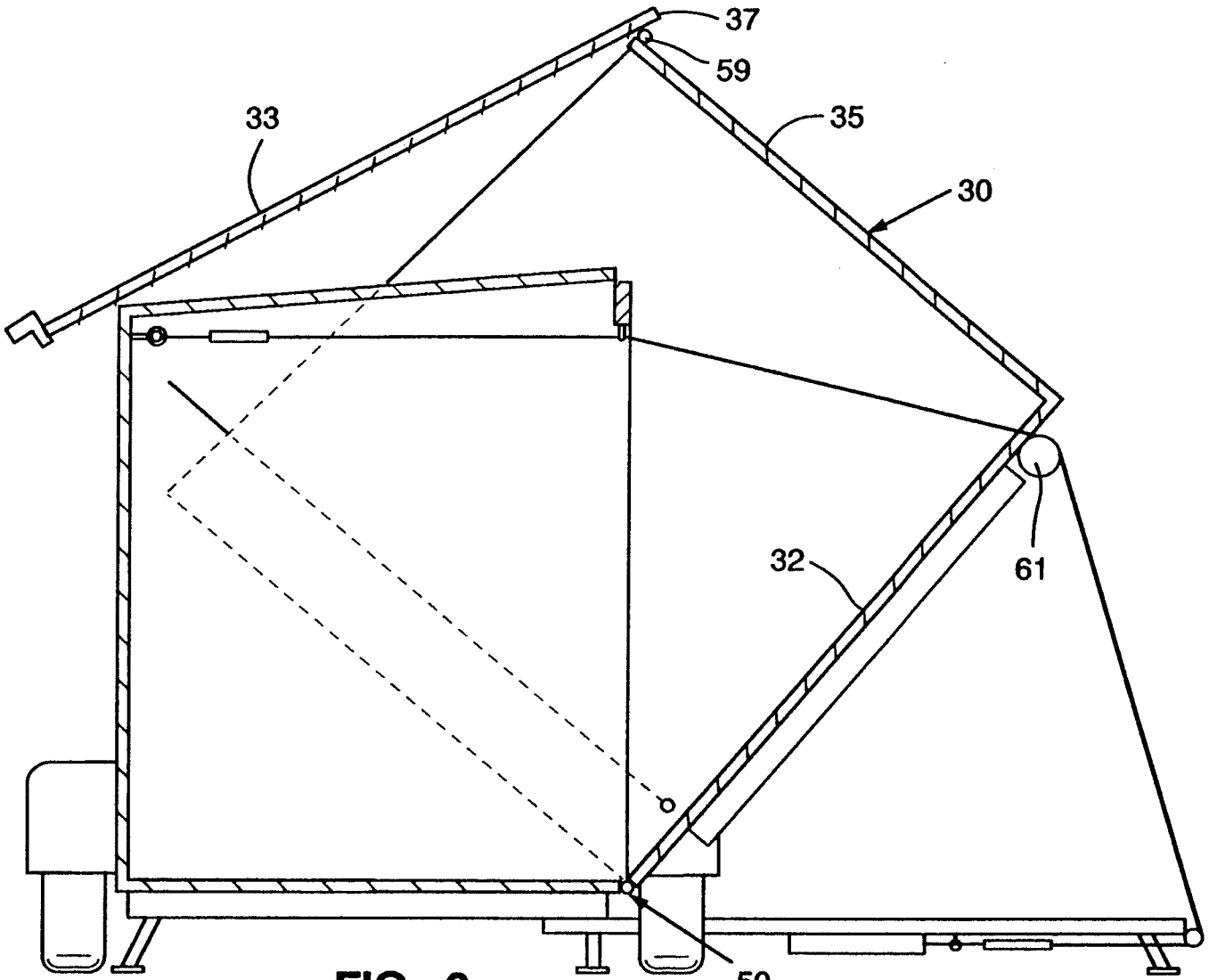
FIG. 6 is a sectional view of the structure as it is about half way between its expanded and retracted configurations.
Figure 7:
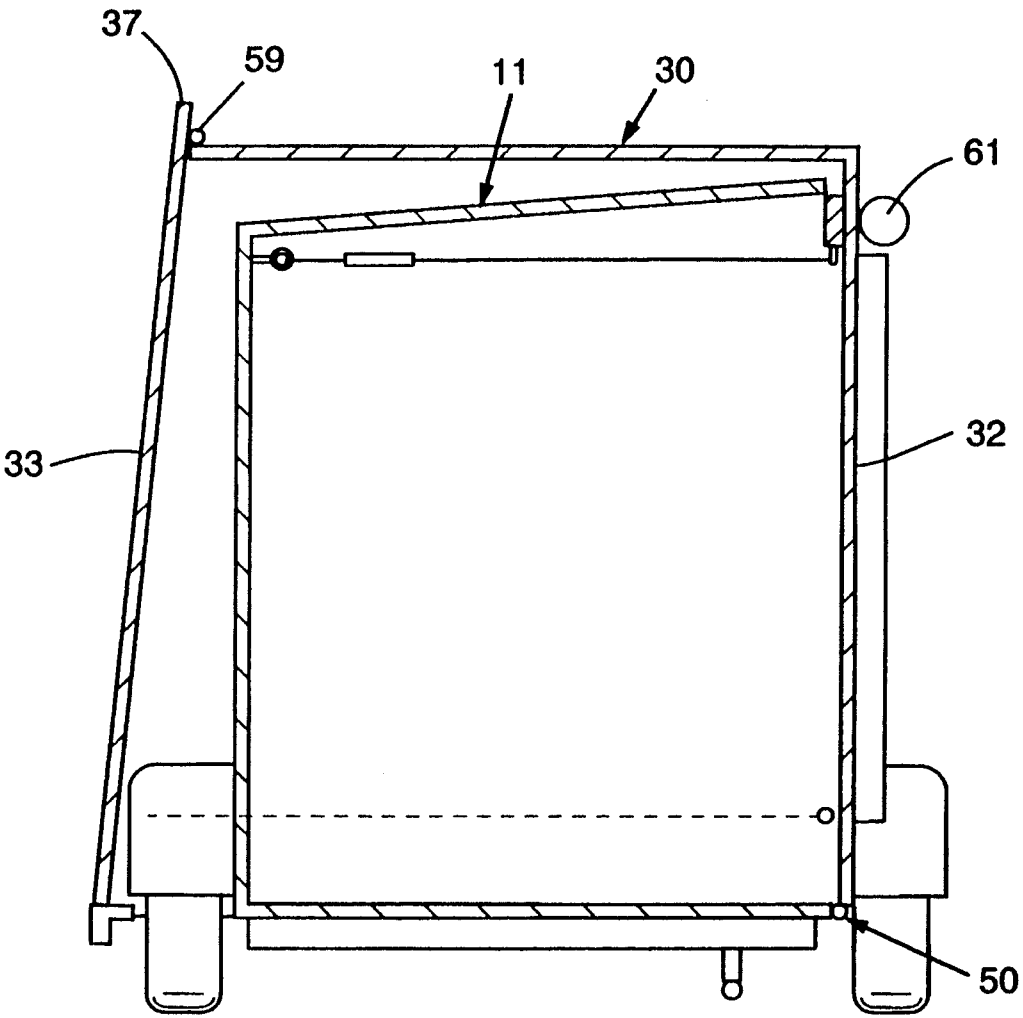
FIG. 7 is a sectional view of the structure in its retracted position.

FIGS. 5A, 6 and 7 show the operation of the mechanism for FIG. 5A, when moving from the expanded to the retracted configuration, the first step is to elevate the roof 33 of movable portion 30. This is accomplished by an elevator means 110. Elevator means 110 includes a vertical shaft 111 concealed in end wall 34 and a similar shaft concealed in end wall 36 of movable portion 30. The vertical shafts are actuated by a manual drive (or optionally an electrical drive) shown schematically as 112. Roof 33 of movable portion 30 is hinged along its outer edge 37 by hinge 59 so that roof 33 can rotate relative to movable side wall 35 about hinge 59.

After the roof 33 of movable portion 30 has been elevated by elevator means 110, winch means 60 is activated and movable portion 30 begins to pivotally rotate about hinge means 50 as shown in FIG. 6. Winch 61 moves with floor 32 to the final position shown in FIG. 7 wherein movable portion 30 has pivotally enclosed stationary portion 11. In this position, the floor 32, roof 33 and end walls 34 and 36 of movable portion 30 form the exterior vertical walls of the retracted configuration and render the retracted configuration secure and resistant to unwanted entry, severe weather, etc.

As shown in FIGS. 5-7, movable portion 30 is generally Cshaped and rotates through approximately 90° between its retracted and expanded configurations.

Figure 8:
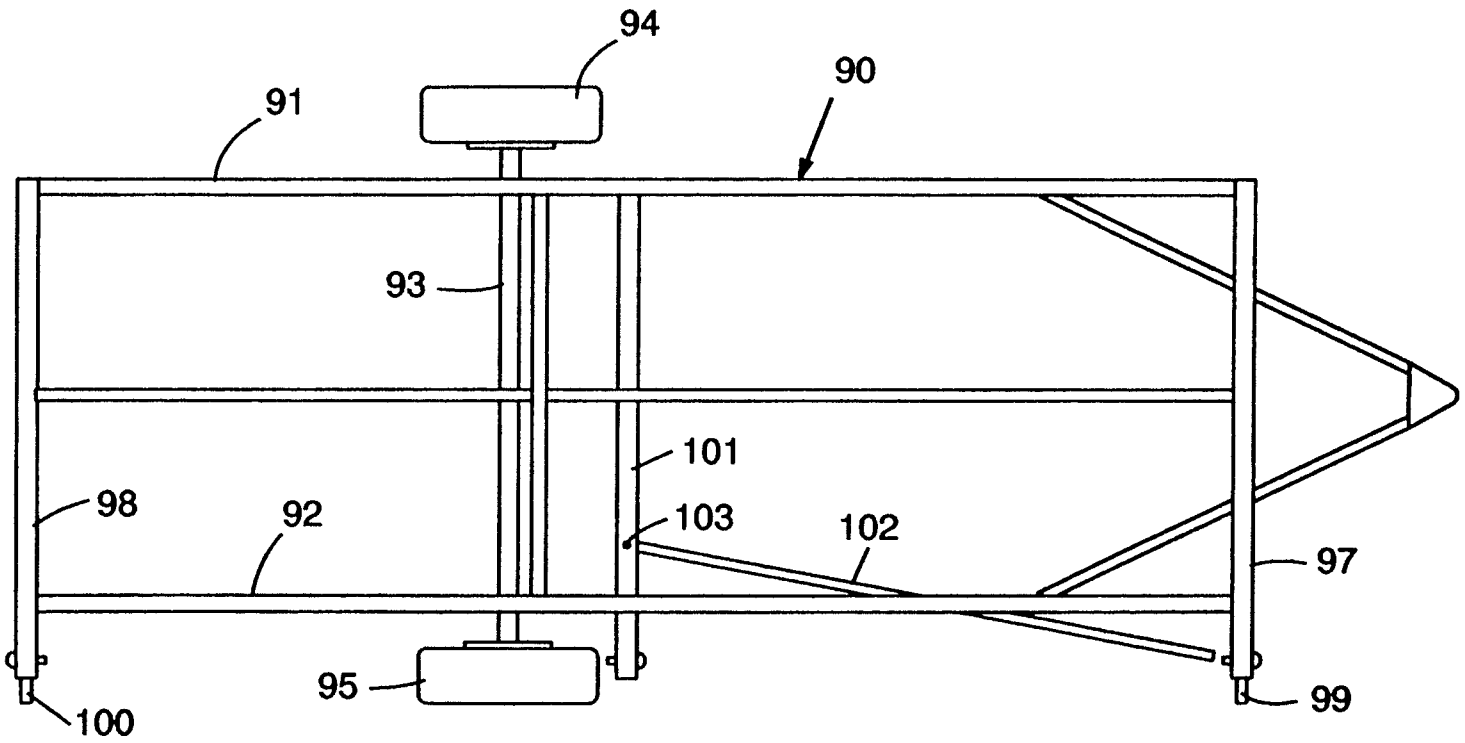
FIG. 8 is a plan view of a wheeled frame which may be used in conjunction with the structure shown in FIGS. 1–7.
Figure 9:
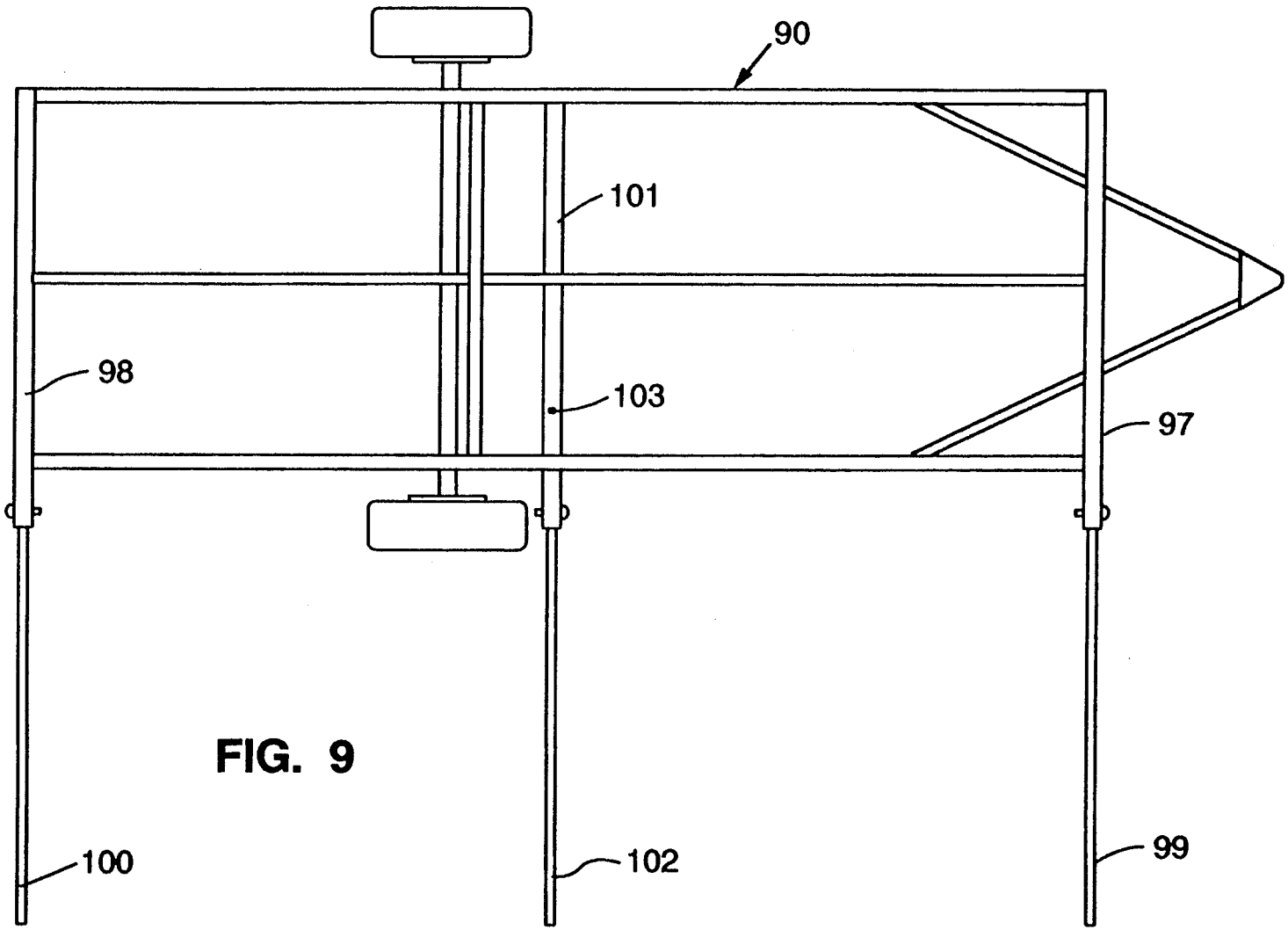
FIG. 9 is a plan view of the wheeled frame shown in FIG. 8 in its position to support the structure in its expanded configuration.

FIGS. 8 and 9 show the wheeled frame 90 which may be used in conjunction with the expandable-retractable structure 10. Wheeled frame 90 includes longitudinal rails 91 and 92 carried by axle 93 which in turn is carried by tires 94 and 95. Front and rear cross members 97 and 98 are hollow and carry movable or telescoping support beams 99 and 100, respectively. Central cross member 101 pivotally carries a central movable support beam 102 which pivots about pin 103. Movable support beams 99, 100 and 102 have a first position shown in FIG. 8 in which support beams are retracted and in which wheeled frame 90 may be moved on a public highway. As shown in FIG. 9, movable support beams 99 and 100 are moved to their second or fully telescoped positions wherein they are ready to support the weight of the movable portion 30 of the structure when movable portion 30 is rotated to its expanded configuration shown in FIGS. 1 and 5. Movable support beam 102 has been pivoted about pin 103 and is shown in its second position in FIG. 9. Each of movable support beams 99, 100 and 102 carries adjustable support jacks 105 shown best in FIG. 5. These adjustable support jacks are attached to the bottom side of members 99, 100 and 102 (and also to the lower side of cross members 97, 98 and 101). The support jacks 105 allow for leveling and support of the structure in its expanded configuration. The jacks swing upward and lock into position for ground clearance during transport.

Figure 10:
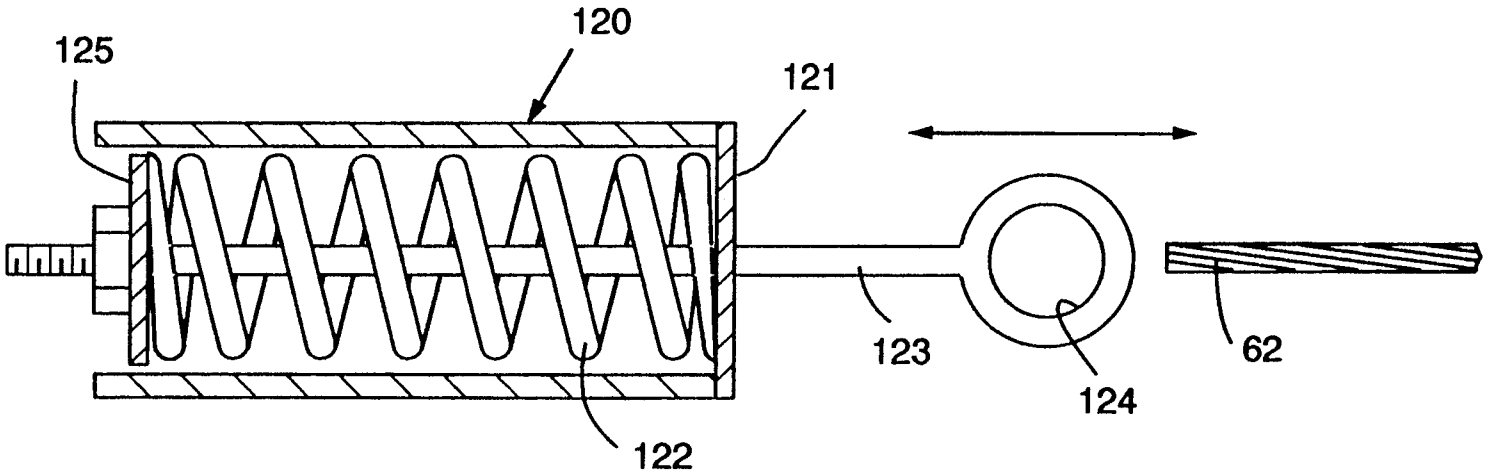
FIG. 10 is a side elevational view, partially in section, of a portion of the structure.

FIG. 10 shows a compression spring assembly 120 rigidly attached to the lower edge of support beam 100. Compression spring 120 includes a cylindrical retaining tube 121 which houses a spring 122. A threaded eye-bolt 123 connects to cable 62 at its circular end 124. The opposite end of eye-bolt 123 is threadably engaged to floating plate 125 which allows for spring action of eye-bolt 123 relative to retaining tube 121. This compression spring assembly absorbs differentials of tautness and slackness of cable 62 during the movement of the structure between its retracted and expanded configurations.

An electrical safety switching system is provided that automatically shuts off power to winch 61 as movable portion 30 reaches its fully expanded or fully retracted configuration. This system includes sensors 131 and 132 located adjacent hinge means 50, sensors 131 and 132 shut off power to winch 61 when contacted by movable floor 32.

I claim:

1. An expandable-retractable portable structure having a retracted configuration to facilitate the structure being transported, and an expanded configuration wherein maximum interior space is available for use, comprising:

a stationary portion having a fixed floor, roof and walls, a movable portion having a floor, roof and walls, said movable portion pivotally enclosing said stationary portion in the retracted configuration of the structure, said floor of the movable portion having an inner edge and an outer edge, said roof of said movable portion being hingedly connected to one wall of said movable portion, said roof forming a vertical, outer wall of said structure in its retracted position, said outer wall being resistance to weather and vandalism, hinge means connected to said inner edge of the floor of said movable portion, and winch means carried by the floor of said movable portion near the outer edge of said floor for rotating said movable portion about said hinge means from said retracted configuration to said expanded configuration, and for rotating said movable portion from said expanded configuration to said retracted configuration; said winch means comprising a reversible winch and a cable wherein one end of said cable is connected to a wall of said stationary portion.

2. The apparatus of claim 1 where in its retracted configuration, the floor and roof of said movable portion form two exterior vertical walls of the structure.

3. The apparatus of claim 1 further comprising:

a wheeled frame which carries the expandable-retractable portable structure, one or more movable support beams carried by said wheeled frame said support beams being movable from a first position in which said wheeled frame may be moved on a public highway to a second, extended position wherein said beams support said movable portion of the structure in its expanded configuration.

4. The apparatus of claim 3 wherein the other end of said cable is connected to one of said movable support beams.

5. The apparatus of claim 3 further comprising a compression spring assembly connected to one end of said cable.

* * * * *

UNITED STATES PATENT OFFICE

CERTIFICATE OF CORRECTION

Patent No. 5,265,394 Dated November 30, 1993

Inventor(s) Stewart E. Gardner

It is certified that error appears in the above-identified patent and that said Letters Patent is hereby corrected as shown below:

Col. 3, line 34, after "for" insert the following ---
both retracting and expanding the structure.
As shown best in ---

Signed and Sealed this

Nineteenth Day of April, 1994

Bruce Lehman

*Attest:*

BRUCE LEHMAN

*Attesting Officer*

*Commissioner of Patents and Trademarks*